United States Patent [19]

Chiolle et al.

[11] Patent Number: 4,510,185

[45] Date of Patent: Apr. 9, 1985

[54] PROCESS FOR THE SURFACE MODIFICATION OF SYNTHETIC FIBERS

[75] Inventors: Antonio Chiolle; Alfio Vecchi, both of Ferrara; Lino Credali, Casalecchio di Reno, all of Italy

[73] Assignee: Montedison S.p.A., Milan, Italy

[21] Appl. No.: 450,268

[22] Filed: Dec. 16, 1982

[30] Foreign Application Priority Data

Dec. 18, 1981 [IT] Italy ..... 25665 A/81

[51] Int. Cl.[3] ..... B05D 7/24

[52] U.S. Cl. ..... 427/222; 427/430.1; 428/378; 428/394; 162/157.5

[58] Field of Search ..... 428/375, 378, 394, 903; 427/222, 430.1; 162/157.5

[56] References Cited

U.S. PATENT DOCUMENTS

| | | | |
|---|---|---|---|
| 3,848,027 | 11/1974 | Forbess et al. | 162/157.5 |
| 3,891,499 | 6/1975 | Kato et al. | 264/13 |
| 4,002,796 | 1/1977 | Baldi et al. | 428/375 |
| 4,374,788 | 2/1983 | Gonzales | 264/5 |

*Primary Examiner*—Shrive P. Beck

[57] ABSTRACT

A process for obtaining water-dispersable polyolefin fibers endowed with a high degree of cohesion consists in maintaining the fibers in contact with a stable emulsion formed by a water solution of polyvinyl alcohol and a poor solvent for the polyolefin, under stirring in turbulence conditions, at a temperature lower than the boiling temperature of the emulsion.

6 Claims, No Drawings

PROCESS FOR THE SURFACE MODIFICATION OF SYNTHETIC FIBERS

BACKGROUND OF THE INVENTION

There are already known for quite some time processes suited for the preparation of synthetic polymeric fibers endowed with such a morphology as to be able to replace wholly or in part the cellulose fibers in the preparation of paper and other such like materials.

Particularly suited synthetic fibers, known in the technical field as "fibrils" or "plexofilament fibrids", have as a general characteristic a high surface area, in general of at least 1 sq.mt/gram, a length comprised between about 0.5 and 10 mm, and a diameter comprised between 1 and 100 microns.

Processes for their preparation are described, for instance, in: British Pat. Nos. 868,651, 891,945, 1,262,531, as well as in German patent application No. 2,343,543, in Belgian Pat. No. 789,808, in U.S. Pat. Nos. 3,770,856, 3,750,383 and 3,808,091 and, finally, in Italian Pat. No. 947,919.

However, particular difficulties are met with in the use of the polyolefinic fibers especially in the field of paper-making, mainly due to the non-polar nature and low density of the polymers, wherefore they are not at all wettable and dispersible in water, while at the same time they display a very poor self-cohesion in the context of leaf-like or panel-like structures, which thus have a breaking length of less than 100 mt.

In the prior art there are known various methods for improving the water dispersibility and the self adhesion power of the polyolefine fibers used in the field of paper-making.

According to French Pat. No. 2,153,941 said fibers are subjected to surface reaction with hydrophile groups of the —$SO_3H$ and —COOH type.

According to another method, disclosed in French patent application Nos. 2,223,442 and 2,257,635, polyolefine fibers are treated with acid aldehydes-modified polyvinyl alcohol, or acetalized polyvinylalcohol, respectively.

At last, in Belgian Pat. No. 787,060 there is disclosed a process which consists in heating a mass of polyolefine fibers, imbued with and/or swollen by a solvent, into an aqueous solution of polyvinylalcohol, up to elimination of the solvent.

According to all these methods only advantages concerning the dispersibility in water are obtained, whereas the self-adhesion power of the fiber is only scarcely improved.

Furthermore, if one tries to develop such characteristics by subjecting the thus obtained synthetic pulp to a refining operation, one obtains only a partial dissolving of the fiber bunches, with a remarkable worsening of the toughness, cohesion and freeness value of the fibrous material, besides an increase in the number of the clots.

THE PRESENT INVENTION

We have now surprisingly found that there can easily be obtained polyolefinic fibrils or fibrids possessing definitely superior suitable paper-manufacturing characteristics, quite near those of cellulose, both with regard to the dispersability in water as well as to the cohesion capacity and the behavior under refining conditions, by maintaining said fibrils in contact with a stable emulsion of an aqueous polyvinyl alcohol solution with a poor solvent for the polyolefin, under stirring and under turbulence conditions, at a temperature below the boiling temperature of the emulsion itself.

By the term "poor solvent for the polyolefin" there must be understood any non-polar solvent in which the polyolefin is insoluble at the temperature at which above mentioned emulsion is used.

More particularly, there are preferred those solvents whose solubility parameters $\delta=(\Delta Ev/V)^{\frac{1}{2}}$ at 25° C., is comprised between 6.5 and 9.5 $(Cal/cu.cm)^{\frac{1}{2}}$ and which belong to class P of solvents poorly hydrogen-bonded) according to the classification by H. Burrel & B. Immergut in: "Polymer Handbook—IV volume, page 341 (1968)".

Examples of solvents belonging to said class are: n-hexane, n-pentane, cyclohexane, cyclopentane, benzene. By the term "stable emulsion" there must be understood a heterogeneous system which, in the present instance, consists of water and a poor solvent for the polyolefin, in which said poor solvent is thoroughly dispersed in the form of microscopical droplets with a diameter not exceeding 0.1$\mu$, in water in which there has been dissolved polyvinyl alcohol (PVA) or one of its water-soluble derivatives, as hereunder defined.

The stable emulsion, used in the process of this invention, is of the "oil-in-water" (O/W) type, and may show either a low, a medium or a high "internal phase ratio" (IPR) (where, by "internal phase ratio" is meant the ratio: "poor solvent" volume/total volume of emulsion), according to the classification of emulsions suggested by K. I. Lissant in the book: "Emulsions and Emulsion Technology"—edited by M. Dekker, Inc. N.Y.—(1978).

From the practical point of view, the preferred emulsions in the process of the present invention are those having a low IPR (internal phase ratio) value, i.e. with a content in "poor" solvent for the polyolefin, below 30% by volume, since they show low dynamical viscosities, even though excellent results may also be achieved by using percentual quantities by volume of "poor solvent" decidedly higher and corresponding to a medium (30–74%) or high (>74%) IPR value.

Together with the PVA or with its derivaties, there may also be used surfactants that show a hydrophile-lypophile equilibrium (HLB) index comprised between 8 and 18. However, the use of such surfactants heavily limits the quantity of PVA or of its derivatives, which remain fixed to the fibers and, as far as they contribute to the stabilization of the emulsions, it is preferable not to use them unless in a quantity below 0.01% by weight on the emulsion.

The heating up of the mixture to a temperature below the boiling temperature of the emulsion, must be carried out under such stirring conditions as to ensure the stability of the emulsion throughout the coating time of the fibers necessary to obtain the desired values of coating.

During said heating the poor solvent may be allowed to slowly evaporate and, once there has been achieved the modification of the fibers, said solvent may be completely eliminated by evaporation; or else, one may keep the emulsion of the composition constant throughout the period of treatment by means of the condensation of the vapors with a suitable condenser.

In this latter case, once there has been obtained a modification of the fibers, these latter may be separated from the emulsion mechanically or there may be first removed the whole of the solvent by heating the emulsion at a temperature greater than above said boiling temperature, at which there occurs the destabilization of the emulsion and a fast evaporation of the solvent itself.

During the heating of the mixture of fibers and emulsion, at a temperature lower than above said boiling temperature and under conditions of stability of the emulsion itself, there occurs an adsorption of the PVA by the fibers and, thus, one obtains the desired surface modification of same.

As has previously been indicated, the operational conditions for an effective treatment are those which allow to ensure the stability of the emulsion at the operational temperature which shall not exceed the boiling temperature of the emulsion itself.

For this purpose, it will be necessary to operate under stirring conditions of turbulence. Said turbulence conditions notoriously occur when the power (P), absorbed by the fluid, turns out to be independent from dynamic viscosity $\mu=\tau/(dv/dy)$ (wherein $\tau$=shearing stress and dv/dy=deformation velocity).

In other words, it is necessary that the power-number Np, given by the relationship: $Np=(P/\gamma N^3D^5)$ (wherein: $\gamma$=specific weight of fluid; N=number of revolutions/second of the stirrer; D=outer diameter of rotor, and P=absorbed power) remains practically constant at the increasing of the Reinolds number: $Re=(D^2N/\mu)$ (wherein $\mu$=density of the fluid), according to what is reported by Perry in: "Chemical Engineers' Handbook", IV vol., page 19.5 (1963).

With regard to the composition of the emulsion, operational conditions and satisfactory results may be obtained by means of emulsions consisting of from 2 to 70% by volume of poor solvent, from 30 to 98% by volume of water and from 0.2 grams to 10 grams of PVA (or of its watersoluble derivatives) per liter of water present.

There may, however, also be used higher values in the above said hexane/water volumetric ratio as well as greater quantities of PVA, which will then give place to more stable emulsions, although they would not be convenient because of the exceeding density and viscosity of the corresponding emulsions, which would make it difficult to operate at the degrees of stirring required. Using, for instance, n-hexane as a poor solvent, particularly satisfactory results will be obtained with volumetric quantities of hexane comprised between 2% and 20%, but preferably comprised between 3% and 10%, and quantities of water from 98–80%, but preferably comprised between 97% and 90%.

As has been previously stated, the operational temperature must be lower than the boiling temperature of the emulsion at the pressure at which one operates, whether one operates at atmospheric pressure or at a greater or lower than atmospheric pressure. At any rate, the operational temperature must be lower than the melt temperature of the polymer as well as lower than the temperature at which the polymer starts dissolving in the solvent. Preferably the operational temperature is comprised within a temperature range nearing the above indicated boiling temperature. For instance, using n-hexane as a solvent and operating at atmospheric pressure, the preferred operational temperature would be comprised between 40° and 60° C.

The degree of modification of the fibers, or the quantity of modifier that is placed on them, in general grows with the increasing of the time of treatment of the fibers in the emulsion and with the quantity of modifier in the emulsion itself, operating under the above indicated conditions.

By means of a suitable choice of the composition of the emulsion and of its temperature, there may however be attained optimal modification degrees in times of a few minutes, for instance from 1 to 3 minutes, and with moderate concentrations, for instance of 0.5–2 g/lt. of modifier in the emulsion.

The quantity of fibers in the emulsion during the modification period or time may vary considerably, but for practical purposes it is generaly maintained within the range of from 5 to 20 g/lt of emulsion.

In the process of the present invention there may be used polyvinyl alcohols (PVA) with a different degree of hydrolisis, although preferred are those with a high degree of hydrolysis, between 88 and 98%, having a viscosity at 20° C., in an aqueous 4% solution, comprised between 20 and 42 centipoises. Amongst the usable polyvinyl alcohols there may be cited those which are at least partially acetalized with aliphatic aldehydes, possibly also carboxylated, such as described in French patent application Nos. 2,223,442 and 2,257,635.

The fibers most suited for being used in the process of this invention, are fibrils showing a superficial area of at least 1 sq.mt/g, made of polyethylene and polypropylene; although the process is also effective on fibers of a different kind, for instance on fibers obtained by fibrillation of polyolefinic films.

The fibrils, after the coating effected according to the method object of this invention, display high papermaking characteristics and mechanical properties that may be further improved by refining. After coating and refining, the fibrils will show extremely high cohesion values (of about 1000–3000 m) which will permit their use in the preparation of new manufactured articles of a high tensile strength, in total replacement of the cellulose (also in admixture with glass-, asbestos-fibers, flat and/or spherical mineral fillers of the mica and talc type, etc.) or in admixture with cellulose in special very-low substance paper (filters for tea) or in admixture with reclaimed leather (imitation leather) or, lastly, with high-tear resistance latexes (non-woven fabrics or tissues).

The following examples are given for purely illustrative and in no way limitative purposes of the scope of the present invention.

In said examples the characteristics of the fibers after the claimed treatment have been evaluated in the following way:

1. Polyvinyl alcohol adsorbed by the fibers:

The degree of adsorption is determined by difference between the weight of the fibers dried after treatment and the quantity of polyolefin extracted by treatment of the fibers with boiling xylene.

2. Surface area:

Is measured by adsorption of nitrogen on a Perkin-Elmer sorptometer according to the BET-method.

3. Mean fiber length:

Is calculated as the mean ponderal length according to the Tappi-T 233 method, using a Lorentz-Wettre classifier and by using as a standard, average values obtained by statistical method through directed reading at the optical microscope.

4. Degree of freenes:

Is determined at 20° C. on 2 grams of fibers dispersed in 1 liter of water by means of a refinometer of the Schopper-Riegler type supplied by Lorentz-Wettre, according to the SCAN C 10 MC 201/74 method.

5. Toughness and interfibrillar cohesion:

These two tests are carried out on 3×10 cm sized test pieces or specimen, cut out from 160 g/sq.cm sheets with a content of 100% of synthetic fibers, prepared on a forming sheet dryer and then conditioned for 24 hours at 23° C. at a relative room humidity of 50%. Said test pieces are thereupon subjected to a tensile stress on an INSTROM Dynamometer at a deformation velocity or rate of 10%/minute (corresponding to a speed of the traverse of 0.5 cm/min.). The ultimate tensile strength (U.T.S.), determined with a distance between clamps of zerospan, gives a measure of the toughness of the fibers; the ultimate tensile strength (U.T.S.) determined with a distance between clamps of 5 cm, gives the measure of the "interfibrillar" cohesion.

Both are expressed as a breaking length BL (respectively marked $BL_0$ and $BL_5$) in meters, according to the formula:

$$BL = \frac{UTS \times 10^5}{G \times L}$$

wherein:

UTS=ultimate tensile strength in Kg.

G=weight of the sheet in g/m$^2$

L=width of test piece in cm.

The above indicated determination procedure is derived from the Tappi T 231 on −70 rule. The reproducability of the measure is 10%.

6. Floating Index:

Is determined by dispersing 2 g of fibrils in 400 cc of $H_2O$, in a Waring-mixer running at maximum speed for 5 seconds, by introducing the suspension into a graduated or scaled 500 cc cylinder which is turned over 4 times and then placed on a horizontal surface, and by then measuring the volumes (Vi) of clear water beneath the fibers suspension after 10, 20, 30, 40, 50, 60, 80 and 120 seconds. These results will be expressed as a flotation index (FI) according to the formula:

$$FI=(Vi/4)$$

7. Elementarizability Index of the fibers:

Is determined by counting the number of points (Np) sinterized on a 20 sq.dm sized sheet consisting of 30% of fibrils and 70% of cellulose, and showing a weight of 60 g/sq.cm, after conditioning it at 23° C. at a relative humidity of 50%, for 24 hours, and after glazing on a calendar at a pressure of 4 Kg/cm$^2$.

EXAMPLE 1 (comparative)

5 g of high-density polyethylene fibrils, obtained according to the process described in Italian Pat. No. 947,919, and characterized in that they have a surface area of 4 sq.mt/g, a mean length of 3.00 mm and a diameter of 18$\mu$, were swollen by treatment with four different quantities of n-hexane at the boiling temperature (68° C.) for 2 hours, in a vessel provided with a reflux coolant and a stirrer.

At the end of this period, each mass of fibers which contained the totality of the admixed hexane, was suspended in 1000 cu.cm of water containing dissolved 2 g of polyvinyl alcohol having a hydrolysis degree of 94, a viscosity at 20° C. in a 4% aqueous solution, equal to 20 centipoises (CP), said polyvinyl alcohol having been acetalized with about 4% of butyrric aldehyde (4 mols of aldehyde for 100 hydroxylic groups).

Each fiber suspension was placed into a glass flask fitted with a reflux coolant, and was maintained under stirring for 10 minutes at 50° C. by means of a laboratory Heidolf R2R type stirrer, provided with a paddle rotor (capable of reaching a peripheral rotational velocity of about 4.2 mt/sec. at a speed of 800 rev.p.min. (rpm); the suspensions, in the absence of reflux cooling, were then brought up to a temperature of 80° C. and maintained at this temperature until full evaporation of the hexane present. During and throughout the treatment, the stirring of the suspension was conducted under conditions of no turbulence (i.e. in a laminar flow). After cooling down to 30 C., the fibers, recovered by filtering, washed with water and finally dried, were converted into sheet and then subjected to characterization.

The results thus obtained have been recorded on Table 1, in which Test 1 relates to polyethylene fibrils analogous to those of the present example, which had, however, been made hydrodispersible by treatment with an aqueous solution of polyvinyl alcohol acetalized with 4% of butyric aldehyde, according to the process described in French Pat. No. 2,257,635, while tests from 2 to 5 refer to the fibrils treated with n-hexane just according to this example.

TABLE 1

| Test No. | Volume of added hexane (cu.cm) | PVA on the fibers (% b.w.) | $LR_5$ cohesion (mt) |
|---|---|---|---|
| 1 | 0 | 0.7 | 60 |
| 2 | 30 | 0.7 | 200 |
| 3 | 50 | 0.6 | 204 |
| 4 | 70 | 0.7 | 170 |
| 5 | 140 | 0.5 | 130 |

EXAMPLE 2 (comparative)

This example relates to the treatment of fibrils of a high-density polyethylene with a non-emulsified mixture of hexane and aqueous polyvinyl alcohol.

5 grams of fibrils quite analogous to those of example 1, were suspended in a mixture consisting of 50 cc of hexane and 950 cu.cm of an aqueous solution containing 2 g/lt of a PVA analogous to that of example 1. This suspension was thereupon brought up to and kept at a temperature of 50° C., under constant stirring for 10 minutes in the same stirring apparatus and under stirring conditions analogous with those of example 1. The suspension was then brought up to 80° C. according to the same procedures as those described in example 1, and was maintained at this latter temperature until complete evaporation of the hexane present.

After cooling down, there was recovered a fibrillar product that turned out to have a content of PVA of 0.9%. After transformation into a sheet, the product showed an $LR_5$ (breaking length$_5$) of 200 mt. Throughout the process the stirring was conducted under non-turbulent conditions, with the two liquid phases in the state of substantial separation.

EXAMPLE 3

This example concerns the treatment of fibers with a stable aqueous emulsion of n-hexane and PVA-containing water, according to the process object of this invention.

5 grams of fibrils of the same type as those described in example 1 were suspended in 1 liter of an emulsion prepared apart by mixing together, at 50° C., 50 cu.cm of n-hexane with 950 cc of water containing 2 g of a polyvinyl alcohol analogous to that of example 1.

Said mixing was carried out under constant stirring in a glass flask provided with a reflux coolant and and IKA-ULTRA-TURTAX TP 45/2G type stirrer fitted with turbine-rotor running at a peripheral velocity of 19 mt/sec. and a rotational speed of 10,000 rev.p.min.

The mixing occurred under turbulence conditions with the formation of a stable emulsion. At the above indicated temperature, stirring and stability conditions of the emulsion, the fibrils were maintained for 10 minutes after which, in the absence of the reflux-coolant, the emulsion was brought up to 80° C., under stirring, whereby there was achieved the fast removal of the n-hexane.

Thereupon, the fibrils were separated by filtering, then washed and finally dried.

Their content in PVA turned out to amount to 5% by weight, while their breaking length ($LR_5$) tested on the formed sheet amounted to 1400 mt.

EXAMPLE 4

Operating in the same way as in example 3, 5 grams of fibrils, of the type and morphology indicated on Table No. 2, were treated with a stable emulsion of 50 cc of n-hexane, 950 cc of water and 2 grams of a PVA having a viscosity, at 20° C. and in a 4% solution, of 42 centipoises and a hydrolysis degree of 88, under turbulence conditions according to example 3.

The results of the treatment have been recorded on Table 2.

TABLE 2

| Fiber-forming polymer | Mean ponderal length of the fibers (mm) | Surface area of fibers (sq.mt/g) | Cohesion ($LR_5$) (mt) |
|---|---|---|---|
| High density polyethylene | 3.2 | 4.7 | 1018 |
| High density polyethylene | 2.6 | 3.6 | 720 |
| High density polyethylene | 2.9 | 6.7 | 1410 |
| Polypropylene | 1.8 | 2.9 | 270* |

*The breaking length cohesion ($LR_5$) of similar polypropylene fibrils, made hydrodispersible by treatment with an aqueous solution of PVA acetalized with 4% butyric aldehyde according to the method described in French Patent Application No. 2,257,635 proved to amount to 40 mt.

EXAMPLES 5(a) and 5(b)

There was repeated example 3, using the same type of fibers, but with the difference that the fibrils were at first suspended in the not-emulsified mixture of n-hexane, water and polyvinyl alcohol (PVA), and that this mixture was subsequently transformed into a stable emulsion by subjecting it to stirring for about 10 minutes at room temperature, by means of a stirrer of the IKA-UNTRA-TURRAX type [example 5(a)] used in examples 3 and 4, and with a laboratory stirrer of the Lorentz-Wettre Mod. 5.3 type (de-pelletizer) fitted with a three-flat bladed rotor, capable of a peripheral velocity of 13 mt/sec. with a revolving speed of 2700 rev.p.-min. [example 5(b)]. Subsequently the temperature of the two emulsions was brought up to 50° C., under stirring in a turbulence condition and under conditions of stability of the emulsions. After 10 minutes the fibers were then separated by filtering.

The breaking length ($LR_5$) of the fibers, measured on the formed sheet, proved to be equal to 1195 mt. in the case of example 5(a), and 815 mt. in the case of example 5(b).

EXAMPLE 6

This example shows the behaviour under refining of the fibers trated with a stable emulsion of hexane, water and PVA (or its water-soluble derivatives) according to this invention, in comparison with the same kind of fibers treated with the same but not emulsified mixture.

690 grams of polyethylene fibrils, prepared through the process described in Italian Pat. No. 947,919, and subsequently treated as described in example 2 (the comparative example), were suspended in 23 liters of water at 30° C., and then subjected to refining in a laboratory hollander of the 3-1 Lorentz-Wettre type, of 30 liters holding capacity, with an applied load of 4.5 Kg.

The course of the refining was kept under control by repeated hourly drawings of fibers.

To a similar treatment on a hollander were subjected 690 g of similar fibrils which were, however, treated according to example 3.

On Table 3 there have been recorded the properties and morphologies assumed by the fibrils treated according to example 2 [fibrils (a)] and according to example 3 [fibrils (b)] during the course of the refining.

| Refining time (hrs) | Properties: Length (mm) | | Freeness (SR°) | | Flotation (cu.cm) | | Pricking (Np) | | Cohesion ($LR_5$) (mt) | | Toughness ($LR_o$) (mt) | |
|---|---|---|---|---|---|---|---|---|---|---|---|---|
| | Type of fibre | | | | | | | | | | | |
| | (a) | (b) | (a) | (b) | (a) | (b) | (a) | (b) | (a) | (b) | (a) | (b) |
| 0 | 4.22 | 4.22 | 12 | 28 | 470 | 30 | 394 | 344 | 131 | 1390 | 2320 | 4740 |
| 1 | 3.63 | 3.82 | 11 | 31 | — | 10 | 3900 | — | — | 1720 | — | 5210 |
| 2 | 2.40 | 3.55 | 11 | 36 | 400 | 0 | 2600 | 232 | 94 | 2510 | 1860 | 5320 |
| 3 | 2.36 | 3.45 | 12 | 39 | — | 0 | 1400 | — | — | 2690 | — | 5480 |
| 4 | 2.18 | 3.35 | 12 | 42 | 310 | 0 | 1600 | 120* | 82 | 3170 | 1690 | 5850 |
| 5 | 1.95 | 3.20 | 12 | 44 | 300 | 0 | 1000 | 44 | 80 | 3440 | 1700 | 6310 |

What we claim is:

1. Process for obtaining water dispersible fibers of olefinic polymers, endowed with a high degree of cohesion, said process consisting in maintaining said fibers in contact with a stable emulsion formed by an aqueous solution of polyvinyl alcohol and a non-polar solvent in which the polyolefin is insoluble at the temperature at which said emulsion is used, under stirring in conditions of turbulence and at a temperature below the boiling temperature of the emulsion.

2. Process according to claim 1, wherein the fibers have a surface area of at least 1 $m^2/g$.

3. Process according to claim 2, characterized in that the emulsion consists of from 2 to 70% by volume of the non-polar solvent, from 30% to 98% by volume of water and from 0.2 to 10 g/lt of water of polyvinyl alcohol.

4. Process according to claim 2 characterized in that the polyvinyl alcohol is at least partially acetalized with aliphatic aldehydes.

5. Process according to claim 3, characterized in that the non-polar solvent is n-hexane, while the temperature is comprised between 40° and 60° C.

6. Process according to claim 1, in which the polyvinyl alcohol is at least partially acetalized with carboxylated aliphatic aldehydes.

* * * * *